US010427323B2

(12) United States Patent
Scherer

(10) Patent No.: US 10,427,323 B2
(45) Date of Patent: Oct. 1, 2019

(54) MIXING AND CONVEYING FACILITY FOR DRY BUILDING MATERIALS FROM A SUPPLY SILO

(71) Applicant: S&P CLEVER REINFORCEMENT COMPANY AG, Seewen (CH)

(72) Inventor: Josef Scherer, Brunnen (CH)

(73) Assignee: S&P Clever Reinforcement Company AG, Seewen (CH)

( * ) Notice: Subject to any disclaimer, the term of this patent is extended or adjusted under 35 U.S.C. 154(b) by 84 days.

(21) Appl. No.: 15/102,533

(22) PCT Filed: Dec. 4, 2014

(86) PCT No.: PCT/IB2014/066596
§ 371 (c)(1),
(2) Date: Jun. 8, 2016

(87) PCT Pub. No.: WO2015/087214
PCT Pub. Date: Jun. 18, 2015

(65) Prior Publication Data

US 2017/0008193 A1 Jan. 12, 2017

(30) Foreign Application Priority Data

Dec. 10, 2013 (CH) ..... 2051/13

(51) Int. Cl.
*B28C 5/12* (2006.01)
*B01F 7/04* (2006.01)
(Continued)

(52) U.S. Cl.
CPC ..... *B28C 5/1284* (2013.01); *B01F 3/1228* (2013.01); *B01F 7/00433* (2013.01);
(Continued)

(58) Field of Classification Search
CPC ..... B28C 5/1284; B28C 5/1276; B01F 7/248; B01F 7/0251; B01F 7/027; B01F 7/0289;
(Continued)

(56) References Cited

U.S. PATENT DOCUMENTS 4,189,242 A * 2/1980 Luke ..... B01F 7/00158 366/288
7,458,716 B2 * 12/2008 Kato ..... A21C 1/06 366/329.2
2005/0014922 A1 * 1/2005 Muller ..... B01F 7/245 528/271

FOREIGN PATENT DOCUMENTS

DE 2166509 A1 * 7/1974 ..... B28C 5/1276
DE 29911546 U1 11/1999
(Continued)

OTHER PUBLICATIONS

Machine translation of DE 2166509, accessed via worldwide.espacenet.com on Nov. 20, 2017.*
(Continued)

*Primary Examiner* — Marc C Howell
(74) *Attorney, Agent, or Firm* — Patshegen IP LLC; Moshe Pinchas

(57) ABSTRACT

The invention relates to a mixing and conveying system for dry mortar materials. The dry mortar materials can be obtained from a storage silo (1) through an openable closure panel (3). A pipe (17), in which a drivable screw conveyor (4) is mounted, is arranged under the closure panel (3). The pipe (17) leads into a mixing and buffer container (18), in which a coil (20) is rotatably mounted on a central axis (19). The mixing and buffer container (18) has a volume which equals at least 1.5-times the minute capacity of the pump-screw conveyor (14). It is thus ensured that the dry mortar material is mixed therein with the added water for at least 90 seconds or longer. The mixing and buffer container (18)
(Continued)

Figure 1:
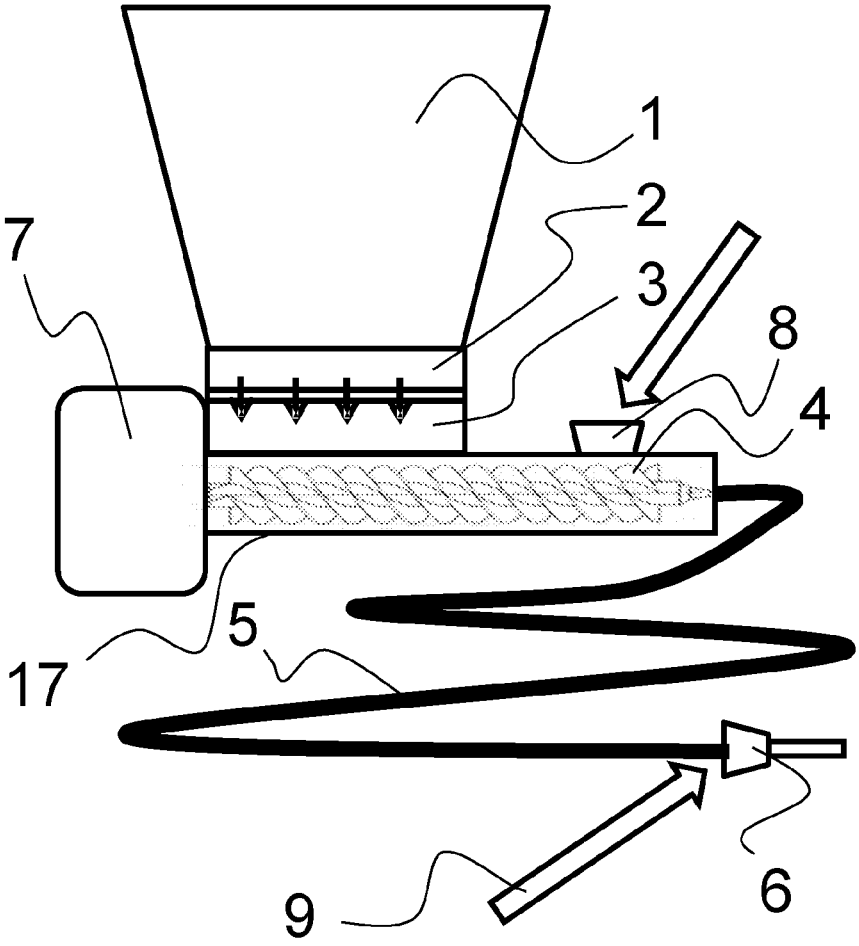

leads into a pipe (15) at the bottom having a pump-screw conveyor (14) which conveys the mixed mortar into a hose (5). The pump-screw conveyor (14) can be allowed to run backward. The coil (20) runs continually such that the mortar is constantly agitated to prevent setting.

7 Claims, 4 Drawing Sheets

(51) Int. Cl.

| | |
|---|---|
| ***B01F 7/24*** | (2006.01) |
| ***B01F 15/02*** | (2006.01) |
| ***B01F 7/00*** | (2006.01) |
| ***B01F 3/12*** | (2006.01) |

(52) U.S. Cl.
CPC ..... *B01F 7/04* (2013.01); *B01F 7/248* (2013.01); *B01F 15/027* (2013.01); *B01F 15/0251* (2013.01); *B01F 15/0289* (2013.01); *B28C 5/1276* (2013.01); *B01F 2003/1257* (2013.01); *B01F 2215/0047* (2013.01)

(58) Field of Classification Search
CPC ..... B01F 7/0065; B01F 7/083; B01F 2215/0047; B01F 3/1228; B01F 7/00433; B01F 7/04; B01F 15/0251; B01F 15/027; B01F 15/0289; B01F 2003/1257
USPC ..... 366/27
See application file for complete search history.

(56) References Cited

FOREIGN PATENT DOCUMENTS

| | | |
|---|---|---|
| EP | 0574728 A1 | 12/1993 |
| EP | 1498175 A1 | 1/2005 |

OTHER PUBLICATIONS

International Search Report.
Explanation of Prior Art Citations in International Search Report.

* cited by examiner

MIXING AND CONVEYING FACILITY FOR DRY BUILDING MATERIALS FROM A SUPPLY SILO

This invention relates to a mixing and conveying facility for dry building materials for construction purposes. These dry building materials are intermediately stored in a supply silo at the building site and are obtained from this, mixed with water and pumped, and then conveyed through a hose, until the mixture subsequently exits from a nozzle and is applied onto a construction object. An addition of compressed air is effected at the spray nozzle for this, so that the pumped mortar can be broken up and sprayed.

The dry building materials, specifically sand, chalk, cement, additives and additional materials are intermediately stored with a minimal intrinsic humidity of less than 0.3% water, in a supply silo on the building site, so as to ensure, provide, mix and convey the spraying mortar. According to the state of the art, for the most part, screw (worm) pumps are applied below the supply silo, which is to say below a closure flap, for the viscous flow conveying/delivery of the dry building materials. A horizontally running drive shaft is provided with a screw (worm), which rotates in a pipe, so that this screw forms a horizontally lying Archimedes' screw. Tempering water is added into this pipe in the necessary quantity, and the mixing of the dry building materials with the water is then effected in this pipe. The screw acts simultaneously as a mixer and a pump and it conveys, which is to say delivers the mixture directly into a pump hose which leads to the spray nozzle. The mixing of the mortar with the tempering water is thus effected in this short screw and thus only during a relatively short time, until the mixture is conveyed out of the screw. The continuity of the mixing procedure is determined by the rotation speed, the length as well as the pitch of the screw on the drive shaft. A long mixing time of 90 to 180 seconds is necessary with highly modified mortars based on polymer. The polymers in the mortar cannot be comminuted or only to an inadequate extent, in the case that this mixing time is not adhered to. The quality of the end product, thus of the mortar mixture is compromised on account of this. The required mixing time is often not reached with conventional, combined mixing pump screws. The screws are too short. The mixing is therefore not effected in an optimal manner and the parameters of this mixing cannot be varied, at the most only the rotation speed of the screw, which however is insufficient.

In practise, interruptions and thus delays occur again and again during the spraying procedure. A continuous conveying is not practically possible at the building site. The mortar remains in the mixing as well as conveying screw during the delay. The mortar stiffens due to the fact that it does not move there. If the mixing and conveying screw is then taken into operation again, the mortar with the stiffer consistency can often no longer be pressed into the conveying hose. This leads to so-called blockages and finally to forced interruption of work. All pump hoses of up to 120m length as well as the mixing and conveying screw need to be work-intensively cleaned in such a case, so that the pumping procedure can be started afresh. This entails significant costs, waiting times for the participating personnel, annoyance and an additional effort for the machine personnel, a loss of mortar and delays in the construction progress with all negative consequences resulting from this.

It is therefore the object of the invention, to provide a mixing and conveying facility for dry building materials from a supply silo, which firstly permits an arbitrarily settable mixing time of the quantity to be conveyed out of the supply silo, so that the high-grade mortar can be given the necessary time for comminuting the polymers which are contained in it, for achieving an optimal mortar mixture, as well as secondly rendering avoidable a setting (stiffening), even in the case of conveying interruptions. Moreover, it should be possible for the mixing and conveying facility to interrupt the conveying process without further ado, without having to worry about the setting of the mortar mixed with the water, but the continued conveying of the tempered mortar should be able to be assumed again after an interruption.

This object is achieved by a mixing and conveying facility for dry building materials which are able to be obtained from a supply silo by way of an openable and closable closure flap, said facility being with a drivable conveying screw which is mounted in a pipe, is arranged below the closure flap and is for the withdrawal of dry building material, said facility being characterised in that a tempering and buffer container with a fitting for the addition of water as well as with an inner, drivable stirrer, is arranged after this conveying screw, and the tempering and buffer container at the bottom runs out into a channel or a cone and into a pipe with a pump conveying screw with its own drive, via which pump conveying screw the mortar mixture processed in the tempering and buffer container can be delivered into the pump hose, wherein the contents of the tempering and buffer container is at least 1.5 times the maximal minute delivery output of the pump conveying screw.

The mixing and conveying facility according to the conventional construction manner, and in comparison to this, embodiments of the facility according to the invention are represented schematically in the drawings and are hereinafter explained by way of this drawing. Thereby, the function of the individual components is explained, and the advantages of these examples of the facility according to the invention are explained.

Figure 2:
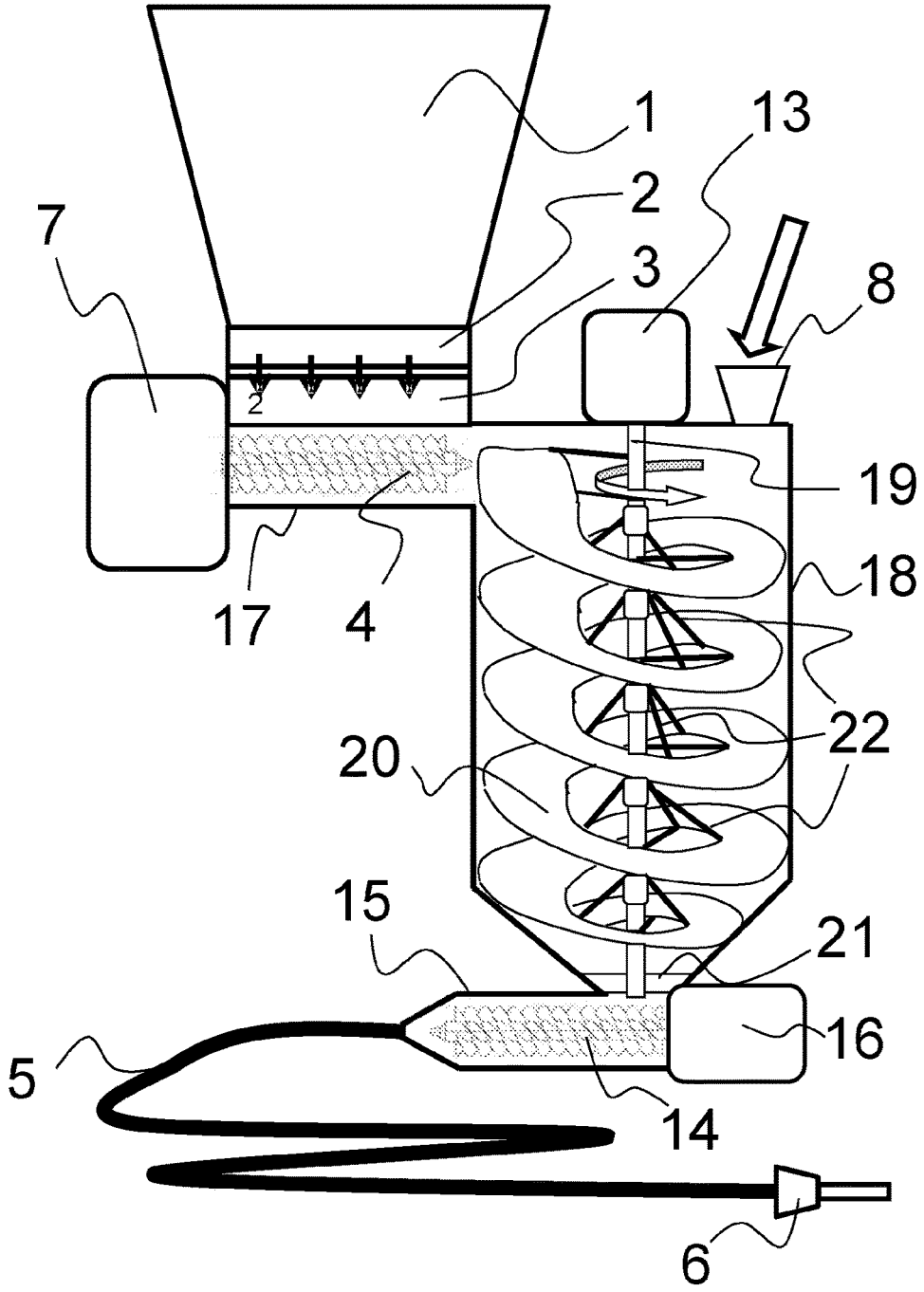
Figure 3:
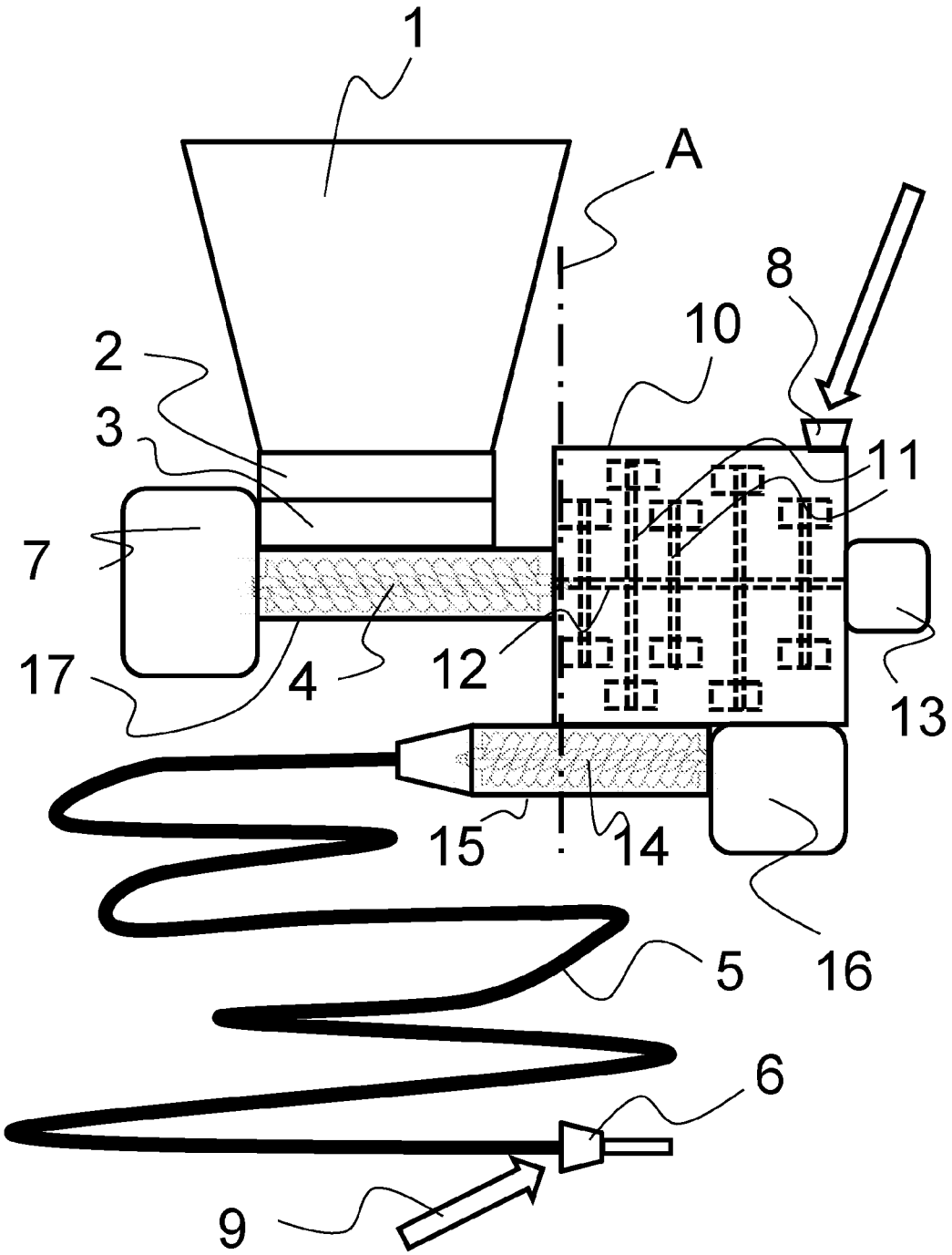
Figure 4:
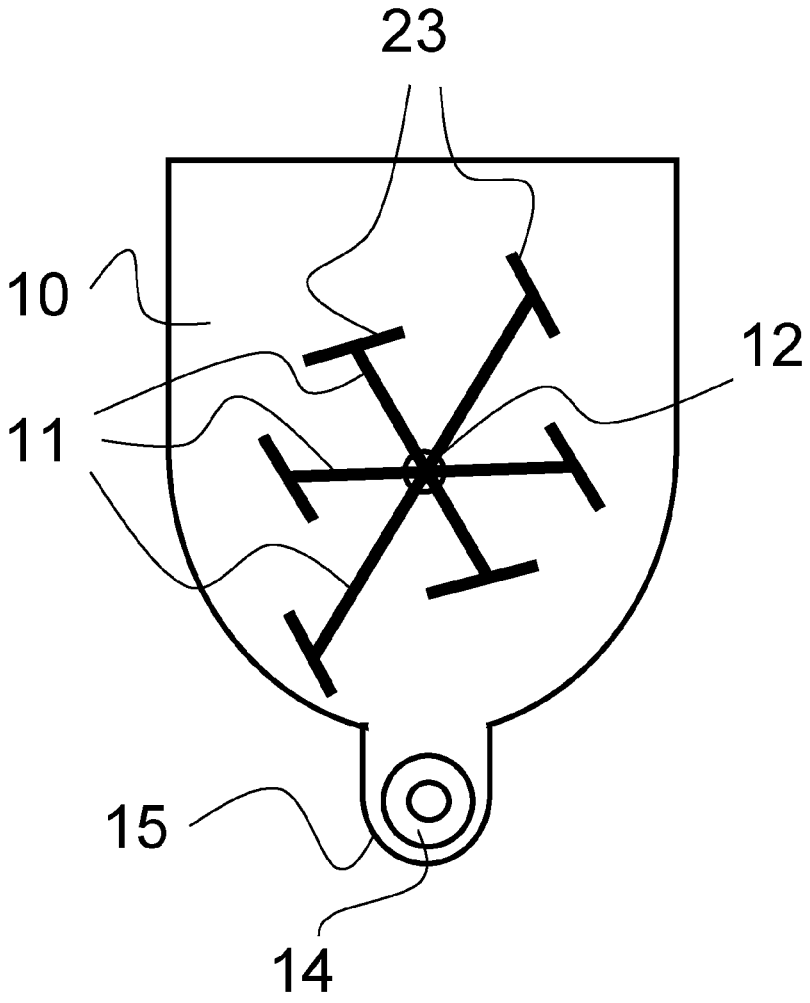

There are shown in:

FIG. 1 a schematic representation of a conventional mixing and conveying facility;

FIG. 2 a schematic representation of the mixing and conveying facility according to the invention, in a first embodiment with a standing (vertical), cylindrical tempering and buffer container;

FIG. 3 a schematic representation of the mixing and conveying facility according to the invention, in a second embodiment with a lying (horizontal) cylindrical drum as a tempering and buffer container;

FIG. 4 a cross section through the tempering and buffer container of the embodiment according to FIG. 3, with its stirrer.

A conventional mixing and conveying facility is firstly represented schematically in FIG. 1. The supply silo 1 here tapers conically downwards and the contents are thereby led to a discharge chute 2 which is provided with a closure flap 3 for the metered issuing of dry building materials. The dry building materials are poured into the pipe 17 with the mixing and conveying screw 4, when the closure flap 3 is opened. This mixing and conveying screw 4 is driven by an electric motor 7. When it rotates, the dry building materials on the one hand are mixed in the inside of this and on the other hand they are also conveyed, in the picture from the left to the right. A filling fitting 8 is integrally formed in the rear region of the pipe 17, in which pipe the mixing and conveying screw 4 rotates. Water can be added here, as is indicated by the arrow. The mixing takes place as soon as the mixing and conveying screw 4 runs, and the stirred mortar is pressed directly into the hose 5 and pumped therein, until its gets to the nozzle 6. Compressed air is fed in there, as is indicted with the arrow 9, so that the mortar comminutes and can be sprayed.

The problem of such a mixing and conveying facility however is the fact that the mixing and conveying process cannot be set or adjusted. It is only the speed of the mixing and conveying screw 4 which can be varied, but this is not satisfactory. As a result, modern, highly modified mortar, to which polymers are added, is not mixed intimately to an adequate extent and the polymers cannot be comminuted at all, and their function in the mortar therefore cannot develop to its fullest extent. Finally, this entails later consequences in the form of constructional deficiencies in the mortar layer of a building. The time period of the mixing with such a facility is mostly only 20 seconds at the most. The mixing duration should be at least 90 to 180 seconds for achieving an adequately homogeneous mixture, with which it is also ensured that the added polymers are completely comminuted in the mortar.

A further problem with these conventional mixing and conveying facilities is to be seen in the fact that the mixing and conveying screw 4 must be completely stopped for each interruption of the spraying of mortar, which in practise is unavoidable. As a result of this, the mortar remains in the pipe 17 with the mixing and conveying screw 4, and it already contains water, and it begins to stiffen after a while. If one waits too long for the spraying to be reassumed, then there is no other option but to clear the mixing and conveying screw 4 by way of disassembly, to remove the stiffened or hardened mortar and after this to reassemble the mixing and conveying screw 4. Moreover, the mortar which remains stuck in the hose 5 must also be removed from the hose by way of water and compressed air, and the hose flushed and cleaned, which although being basically possible due to the elasticity of the hose, is however very work-intensive, just as the disassembly and assembly of the mixing and conveying screw 4 requires much effort.

The interruption of the spraying work with such a mixing and conveying facility thus always entails the risk of the work not being able to be reassumed without any problems.

A first embodiment of the mixing and conveying facility according to the invention is likewise schematically represented in FIG. 2. In contrast to the conventional facility, this mixing and conveying facility comprises a separate tempering and buffer container 18, in which, as the name states, the mortar is tempered by way of mixing. Its volume is at least 1.5 times the minute conveying (delivery) output of the pump conveying screw 14 at its lower end. Typical conveying outputs of these pump conveying screws 14 are approx. 30 to 40 litres per minute, wherein a conveying output which is to say delivery rate of 50 litres per minute is achieved at a maximal speed of 400 r.p.m. at full motor power, but one seldom operates at such conditions. The tempering and buffer container 18 then preferably comprises a volume of approx. 60 litres. It should have at least 1.5 times the volume of the minute conveying output of the pump conveying screw 14, so that the minimum mixing time of 90 seconds is achieved, or also an even longer mixing time. The tempering and buffer container 18 in the shown embodiment example is a standing cylinder which tapers conically downwards into a run-out, and in the drawing is represented in a half-open manner, thus whilst omitting the front cylinder wall, in order to obtain a view to the inside. A spiral 20 is led along the inner wall of the cylindrical container in the inside of this container, but is not connected to the inner wall. The spiral 20 with its outer edge can be led along the inner wall of the cylindrical tempering and buffer container 18 along a helix, so that it has a constant pitch over its whole length. Alternatively, its outer edge can also describe a non-uniform spiral, so that it therefore has a varying pitch over its length. A central shaft 19 leads from an electrical motor 13 axially through the cylindrical tempering and buffer container 18. This shaft 19 is connected to the spiral 20 via a number of fixed and stable members 22, so that this spiral can likewise be brought into rotation by way of rotating the shaft 19. The shaft 19 at the bottom is held in a bearing 21 for stabilisation. The tempered mortar after the mixing with the water which is fed through the filling fitting 8 is firstly buffered in the tempering and buffer container 18, so that it does not set. The continuous rotation of the spiral 20 serves for this, by which means the mortar is constantly conveyed upwards, where it falls down again through the central free space in the spiral 20 and is therefore kept in constant motion. Mortar for spraying and which is ready-processed can be obtained from this tempering and buffer container 18 depending on the need, for which the tempering and buffer container 18 at the bottom of this tempering and buffer container runs out into a pipe 15 with the pump conveying screw 14. If this pump conveying screw is left in running operation by a separate motor 16, then it pumps spraying mortar into the pump hose 5. The pump conveying screw 14 can be left running backwards for interrupting the pumping. With this, it delivers or conveys back the mortar stuck in the pipe 15 and presses it constantly upwards into the tempering and buffer container 18.

The facility is operated as follows. Firstly, the closure flap 3 of the discharge chute 2 of the supply silo 1 is opened, so that dry building material falls through the discharge chute 2 into the pipe 17 with the conveying screw 4. The conveying screw 4 is driven by the electric motor 7 and displaces the dry building material to the right in the picture, into the tempering and buffer container 18. Only now is water metered through the filling fitting 8 depending on the measure of the fed quantity of dry building material. The quantity of the dry building material has a certain ratio to the running duration of the conveying screw 4. The water can be metered to a sufficiently accurate extent by way of this. The dry building material from now on is mixed with water in the tempering and buffer container 18, by way of the spiral mixer rotating in the inside of the tempering and buffer container 18. A mixing duration of 90 seconds is thereby adhered at all events, since the material which is located in the lower conical feed, is engaged by the spiral 20 and conveyed all the way to the top and must then fall downwards over the members 22 in a cascade-like manner, which is repeated several times. The tempering and buffer container 18 is firstly filled to a large extent, and then one mixes and after this buffers for a while, for example for 90 to 180 seconds long or for several minutes. From now on, the mixed mortar can be conveyed away at the bottom via the pump conveying screw 14 and be conveyed into the pump hose 5, whereas with regard to quantity, the same amount of dry building material and water is fed at the top, for a uniform conveying, so as to ensure a continuous processing or mixing and subsequent buffering. The mixing procedure with this facility, subsequently to the feed of water is therefore separated from the conveying into the connecting pump hose 5. This means that the mixing procedure continues to progress, even if the conveying screw 4 for obtaining dry building material is shut down, and the separate pump conveying screw 14 is set to run backwards for interrupting the pumping.

An alternative embodiment of the device is shown in FIG. 3, with a tempering and buffer container 10 in the form of a lying, which is to say horizontal drum. A shaft leads horizontally through this tempering and buffer container 10 and carries radially projecting paddles 11 with shovels as paddle ends. This shaft 12 is driven by a separate, individual motor 13. The shaft 12 is rotated as long as this motor 13 runs, and the paddles 11 stir the mortar in the inside of the tempering and buffer container 10 in a wet and continuous manner, so that a stiffening is prevented. The contents of the tempering and buffer container 10 are at least double the amount as that of the pipe 17 which is with the conveying screw 4, is arranged upstream and from which the tempering and buffer container 10 is charged. A larger buffer can also be provided, depending on the size of the tempering and buffer container 10, so that an adequate mixing time is always achieved, and the facility can simultaneously continue to run for a pure mixing or buffering also without any spraying of the mortar, and thus a setting of mortar in the facility can be avoided. The feed of water is effected directly into the tempering and buffer container 10 through the fitting 8 on its upper side. At the bottom, the tempering and buffer container 10 runs into a channel which simultaneously forms the pipe 15 of a pump conveying screw 14, and this screw is driven by an individual motor 16. The pipe 15 of this conveying screw 14 runs out into the hose 5 and this hose ends at a nozzle 6, at which compressed air can be admetered, as is indicated by the arrow 9.

In FIG. 4, the tempering and buffer container 10 according to the representation in FIG. 3, in this drawing is represented as seen from the right onto the facility, and specifically in a section through the plane of the dot-dashed line A in FIG. 3. The tempering and buffer container 10 is shaped in a semi-circular manner at the bottom, thus forms a channel. The shaft 12, on which the paddles 11 are radially arranged, extends through the tempering and buffer container 10. The paddles 11 are provided with shovels 23 which are preferably arranged obliquely with respect to the paddles 11. In the shown representation, they rotate in the anti-clockwise direction. At the bottom, the tempering and buffer container 10 runs out at its lowest location into a smaller channel forming the pipe 15 of the pump conveying screw 14 which conveys in a wet manner. If the pump conveying screw 14 is idle or runs counter to its conveying direction and the paddles 11 simultaneously rotate in the tempering and buffer container 10, then a setting of the stirred mortar in the tempering and buffer container 10 and in the pipe 15 is effectively avoided. Interruptions on spraying the mortar are simply bridged by way of this, as is described in more detail hereinafter.

If, for whatever reason, it is not possible to spray any further—thus the spraying of the mortar must be interrupted—then the pump conveying screw 14 which indeed is solely responsible for delivery or pumping of the stirred, wet mortar through the hose 5, can be immediately shut down. If required, it can also left running in the reverse direction. Then, at its rear end, it presses the mortar up into the tempering and buffer container 10, since there is otherwise no place for it to escape. However, in the tempering and buffer container 10, it is continuously engaged by the shovels 23 of the paddles 11 and stirred, by which means it cannot stiffen or even harden or set. The closure flap 3 of the supply silo 1 is also simultaneously closed with the stoppage of the pump conveying screw 14. The dry building material and mortar still located in the conveying screw 4 is still conveyed into the tempering and buffer container 10, and mixed with water therein, until the pipe 17 with the conveying screw 4 is empty. The mortar conveyed into the tempering and buffer container 10 from now on remains in the tempering and buffer container 10 and is continuously stirred, until the spraying is reassumed. The conveying screw 4 can be shut down as soon as the pipe 17 with the conveying screw 4 is emptied, which is to say all the contents have fallen into the tempering and buffer container 10. It is solely the paddles 11 in the tempering and buffer container 10 which are kept in motion during an extended interruption, or if required, the pump conveying screw 14 is left running in the counter-delivery direction. The tempering and buffer container is at least 1.5 times as large as the minute delivery output of the pump conveying screw 14 or even larger, if an a larger buffer of stirred mortar is demanded, so that the tempering and buffer container 10 at all events can receive the contents of the conveying screw 4, and an adequate mixing duration is ensured in it. Working interruptions are significantly reduced with this facility. Material losses can also be reduced thanks to this facility, by way of hardly any mortar having to the thrown away due to it having stiffened or set.

The tempering and buffer container 10, 18 moreover basically serves as an additional mixing device, in order to ensure an extended mixing time, however a mixing time of at least 90 seconds, wherein a longer mixing time however can also be ensured at all times. It lasts at least 90 seconds until dry building material which falls into the conveying screw 4 from the supply silo 1, is delivered by this into the tempering and buffer container 10, 18, the mortar is mixed further therein and is finally engaged at the bottom by the pump conveying screw 14 and is pumped by this into the hose 5. If additional mixing time is necessary, then the facility can be left to run even more slowly, or the pump conveying screw 14 can even be stopped now and then or be allowed to be left to run in the reverse direction, in order to mix the mixture firstly in the mixing and buffer container 10 in a particularly intimate, which is to say thorough manner. However, given a normal rotational speed, the mixing time is more than 90 seconds in any case, when required 180 seconds, and this ensures the reliable comminutation of all polymers which are contained in a highly-modified mortar based on polymer.

The invention claimed is:

1. A mixing and conveying facility for dry building material, the facility comprising a first pipe (17), wherein said first pipe (17) is configured to receive dry building material from a supply silo (1), downstream which first pipe (17) a tempering and buffering container (10, 18) is arranged, such that said building material is processable into said tempering and buffering container (10, 18), said tempering and buffering container (10, 18) including a fitting (8) for adding water to the dry building material, and an inner, drivable stirrer, wherein said stirrer comprises a shaft (19, 12) from which a shovel means (20, 23) projects, and wherein the tempering and buffering container (10, 18) at the bottom runs out into a cone or channel, wherein the facility further comprises a second pipe (15) with a conveying screw (14) with its own drive (16) and a pumping hose (5), wherein the building material mixture processed in the tempering and buffering container (10, 18) is conveyable via said conveying screw (14) into said pumping hose (5) for application, characterized in that the facility is configured for an arbitrarily settable mixing time of the quantity of building material to be conveyed out of the supply silo (1) in such a way that said second pipe (15) and said conveying screw (14) are arranged fittingly to the cone or channel of the said tempering and buffering container (10, 18) for co-acting upon interrupting the application process, in that the said conveying screw (14) in said second pipe (15) is operable in reverse mode such that said building material is constantly conveyed back and at the rear end is pressed upward-into said tempering and buffering container (10, 18), as there is otherwise no place for the said building material to escape.

2. A mixing and conveying facility for dry building material according to claim 1, wherein said tempering and buffering container (18) is a cylindrical container with a downwardly conically tapering lower end, and wherein the said shovel means is a spiral (20) projecting from the shaft (19) by way of members (22), wherein the outer helical line of the spiral (20) runs along the inner wall of said container (18).

3. A mixing and conveying facility for dry building material according to claim 2, wherein said tempering and buffering container (18) at its upper side comprises an electric motor (13), whose driven shaft (19) axially runs through said tempering and buffering container (18), such that the spiral (20) can be rotated by the driven shaft (19).

4. A mixing and conveying facility for dry building material according to claim 1, wherein said tempering and buffering container (10) forms a horizontally mounted drum, and wherein the said shovel means is at least one paddle (23) projecting from the said shaft (12) by way of a paddle rod (11).

5. A mixing and conveying facility for dry building material according to claim 4, wherein multiple paddle rods (11) are provided on said shaft (12), wherein said paddle rods (11) have different lengths.

6. A mixing and conveying facility for dry building material according to claim 1, wherein an additional drivable conveying screw (4) is mounted in said first pipe (17), wherein said additional conveying screw (4) is configured for processing dry building material into said tempering and buffering container (10, 18), wherein said additional conveying screw (4), said stirrer as well as said conveying screw (14) of the said second pipe (15) each have their own electric motor (7, 13, 16) as a drive and can be operated independently of one another.

7. A method for mixing and conveying dry building material by a facility according to claim 1, wherein the building material is released from said supply silo and processed by said first pipe (17) into said tempering and buffering container (10, 18), wherein the building material is provided with water by way of said fitting (8) and is stirred by said inner, drivable stirrer by way of said shovel means (20, 23) projecting from said shaft (19, 12), wherein said building material is stirred by way of said shovel means (20, 23), wherein said building material, when it falls downstream, is conveyed via said conveying screw (14) into said pumping hose (5) for application, characterized in that on interrupting the application process the conveying screw (14) is left running in the reverse operation mode, wherein by way of said conveying screw (14) and said second pipe (15) being arranged fittingly to the cone or channel of the said tempering and buffering container (10, 18), said building material is conveyed constantly back and at the rear end is pressed into said tempering and buffering container (10, 18) for being stirred anew.

* * * * *